United States Patent [19]

Okinaka et al.

[11] 4,067,783

[45] Jan. 10, 1978

[54] GOLD ELECTROPLATING PROCESS

[75] Inventors: Yutaka Okinaka, Madison; Catherine Wolowodiuk, New Providence, both of N.J.

[73] Assignee: Bell Telephone Laboratories, Incorporated, Murray Hill, N.J.

[21] Appl. No.: 779,714

[22] Filed: Mar. 21, 1977

[51] Int. Cl.[2] ..... C25D 3/48; C25D 3/62

[52] U.S. Cl. ..... 204/43 G; 204/46 G; 204/290 F

[58] Field of Search ..... 204/46 G, 43 G, 290 F, 204/109, 110, 111

[56] References Cited

U.S. PATENT DOCUMENTS

| | | | |
|---|---|---|---|
| 3,428,544 | 2/1969 | Bianchi et al. | 204/290 F |
| 3,491,014 | 1/1970 | Bianchi et al. | 204/242 |
| 3,616,445 | 10/1971 | Bianchi et al. | 204/290 F |
| 3,711,385 | 1/1973 | Beer | 204/290 F X |
| 3,865,703 | 2/1975 | Schenker et al. | 204/105 R |
| 3,926,751 | 12/1975 | DeNora et al. | 204/105 R |
| 3,980,531 | 9/1976 | Ludwig et al. | 204/43 R |

FOREIGN PATENT DOCUMENTS

| | | | |
|---|---|---|---|
| 6,616,173 | 5/1967 | Netherlands | 204/46 G |

OTHER PUBLICATIONS

D. Cipvis et al., J. Electroanal, Chem., 73, 125–128, (1976).

F. H. Reid et al., "Gold Plating Technology," pp. 21–52, (1974).

F. A. Lowenheim, "Modern Electroplating," pp. 224–244, (1963).

*Primary Examiner*—G. L. Kaplan

*Attorney, Agent, or Firm*—Walter G. Nilsen

[57] ABSTRACT

Certain reducible species are found in gold electroplating solutions which interfere with efficient electroplating of gold and make uncertain gold thickness predictions based on current throughput. A gold electroplating process is described which minimizes formation of undesirable reducible species. This process uses an anode of titanium having a coating of the oxides of ruthenium, iridium, rhodium, titanium or mixtures thereof. In addition, a procedure is described for removing such chemical species from the gold plating bath which does not adversely affect the gold electroplating solution.

11 Claims, 3 Drawing Figures

GOLD ELECTROPLATING PROCESS

BACKGROUND OF THE INVENTION

1. Field of the Invention

The invention is a process for electroplating gold.

2. Description of the Prior Art

Gold electroplating procedures are extensively used in a variety of industrial applications. Gold plating is used in the fabrication of jewelry and cosmetic articles as well as industrial articles and electrical devices. In certain applications in electrical devices it is particularly advantageous because of its good electrical conductivity, its chemical and physical stability, and freedom from corrosion. Gold electroplating is extensively used with increasing quantities in recent years as conducting paths and contacts in electrical devices. Because of the high cost of gold, it is economically advantageous to minimize the amount of gold used without significant degradation in device performance. In particular, the high cost of gold as well as time factors involved in gold plating processes makes it highly desirable to extend the useful life of gold plating solutions as much as possible. Another result of the high cost of gold is the desire to be able to predict gold layer thickness with considerable accuracy so that minimum standards can be met without excessive overplating.

With extended use of gold plating solutions it has been found that plating efficiency (amount of gold plated per quantity of electricity) decreases and becomes quite uncertain. In order to meet minimum requirements for a particular gold plating application it becomes necessary to deliberately overplate in order to insure minimum thickness requirements. This procedure is often quite wasteful of gold which is economically undesirable. This uncertainty in predicting gold thickness as the age of the plating solution increases often limits the life of the plating solution and requires more frequent replacement of the gold plating solution.

Various anodes have been described in the literature. Many of these anodes are structurally unsuitable for gold plating (see for example Guiseppe Bianchi et al, U.S. Pat. No. 3,428,544 issued Feb. 18, 1969, and Guiseppe Bianchi et al, U.S. Pat. No. 3,491,014 issued Jan. 20, 1970). Other anodes are used in applications quite different from gold electroplating (see for example Guiseppe Bianchi, U.S. Pat. No. 3,616,445 issued Oct. 26, 1971).

SUMMARY OF THE INVENTION

The invention is a gold electroplating process carried out under conditions which minimize formation of undesirable reducible species in the gold plating bath. Particularly significant in the process is the use of an anode made of titanium coated with a mixture of various oxides. Oxides of ruthenium, iridium and rhodium, as well as titanium, are particularly suitable. Other oxides may be included both as filler to distribute advantageously the more active oxides and insure good electrode characteristics. Such other oxides preferably should not exceed 75 percent by weight of the anode coating. Oxides of ruthenium and iridium are preferred because of high catalytic activity. This type of anode is often referred to as a dimensionally stable anode. Further, a procedure is described for removing undesirable reducible species. This procedure does not affect the gold plating properties of the bath and permits continued use of the bath. In addition, gold plating procedures carried out in accordance with the invention permit accurate prediction of gold layer thickness from electrical parameters used in the plating process.

DETAILED DESCRIPTION

Figure 1:
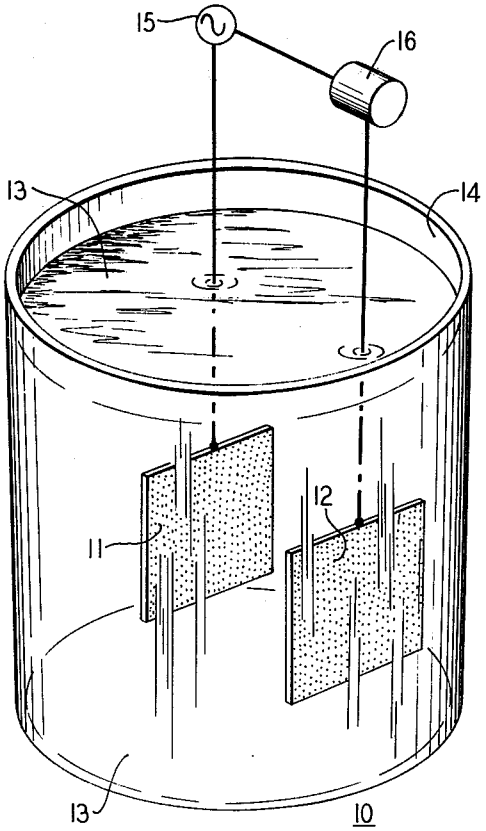
FIG. 1 shows a gold plating apparatus with anodes useful in the practice of the inventive process.

In general terms, the invention is a gold plating procedure which minimizes or eliminates the formation of reducible species other than monovalent gold complexes which might decrease and make uncertain the efficiency of the gold plating bath. The formation of such species not only decreases efficiency and thereby wastes energy, but also increases the uncertainty in predicting gold plating thickness on the basis of the amount of current used. In practical manufacturing situations, this requires increased plating thickness in order to insure meeting minimum requirements.

Central to the gold plating process is the use of an anode with a particular structure. The base of this anode is made of titanium and coated with one or more metal oxides. Generally, these metal oxides are selected from the oxides of ruthenium, iridium, rhodium, and titanium. These materials may be present in pure form or mixed together. The oxide of titanium is generally mixed with the other oxides. Other materials may be present to provide adherence, proper surface properties, etc. Some anodes and preparation methods are given by D. Cipvis and D. Pouli in an article entitled *Oxygen Evolution on Dimensionally Stable Anode Materials* published in *Journal of Electroanal. Chem.* 73, 125–128 (1976). A large variety of procedures including mechanical and chemical procedures may be used to fabricate the anode.

Generally, anode preparation begins with a titanium screen. Chlorides or oxides of the metal to be coated on the titanium are dissolved in a suitable solvent such as dimethylformamide, methanol, etc., coating is accomplished by alternately dipping the titanium screen in the solution and drying the screen. Extensive repetition of this procedure is usually necessary to obtain good electrodes.

A specific example may be of value in practicing the invention. Titanium trichloride in HCl solution is dissolved in methanol. Hydrogen peroxide is added to convert $TiCl_3$ to $TiO_2$. Sufficient $RuCl_3.3H_2O$ is dissolved in methanol to give the desired final ratio of $TiO_2$ and $RuO_2$. The two solutions are then mixed and the resulting solution applied to a clean titanium anode surface. Alternate application and baking (usually at about 350 degrees C) is carried out until desired thickness or weight per unit area is obtained. Generally, the deposit is given a final heat treatment above 350° C, usually at about 450° C in air.

This gold plating procedure may be practiced with a large variety of gold plating baths. The dimensionally stable anode may be used throughout the pH range generally used in gold plating baths. The pH range from 3 to 10 is preferred. Above pH 10, trivalent gold species generally are not stable and below pH 3, gold cyanide complexes generally used in gold electroplating solutions are not stable.

Sample gold plating solutions with plating conditions are as follows:

| | |
|---|---|
| 1. Hard Gold | |
| Potassium gold cyanide KAu $(CN)_2$ | 4–46 gm/l |
| Citric acid anhydrous | 80–120 gm/l |
| KOH | 40–60 gm/l |
| pH | 3.0–5.0 |
| Cobalt citrate | 20–200 ppm |
| 2. Hard Gold | |
| Potassium gold cyanide | 4–46 gm/l |
| Phosphoric acid to adjust pH to approximately 4.2 | |
| Cobalt citrate | 20–200 ppm |
| 3. Soft Gold | |
| Potassium gold cyanide | 12–46 gm/l |
| Potassium hydrogen phosphate | 40 gm/l |
| Potassium dihydrogen phosphate | 10 gm/l |
| This yields a solution with pH approximately 7.0 and plating is usually carried out at a temperature of approximately 65 degrees C. | |
| 4. Soft Gold | |
| Potassium gold cyanide | 2–30 gm/l |
| $(NH_4)_2 HC_6H_5O_7$ | 7–40 gm/l |
| pH 5 – 6.5. Plating is usually carried out at approximately 65 degrees C. | |

Bath solution 1 and 2 above are usually used around room temperature or slightly above, although they may be used up to the boiling point of the solution. Bath solutions 3 and 4 are usually used above room temperature.

Other bath formulations may be found in the literature. Two well known references are: *Gold Plating Technology* by F. H. Reid and W. Goldie, Electrochemical Publications Limited, 1974, and *Modern Electroplating* edited by F. W. Lowenheim, 2nd Edition, Wiley, New York, 1963.

FIG. 1 shows an idealized setup 10 which is useful in the practice of the invention. This drawing shows the anode 11 made in accordance with directions given above together with the cathode 12 on which gold is plated. The gold plating solution 13 is held in a container 14. The apparatus also includes a source of electrical energy 15 and a device 16 for measuring and controlling current.

Polarographic studies of gold plating solutions may be used not only to demonstrate the advantages of the inventive process but also to estimate the concentration of the gold III species in the solution. Such concentration estimates may be used to determine amounts of chemicals necessary to eliminate such gold III species.

Figure 2:
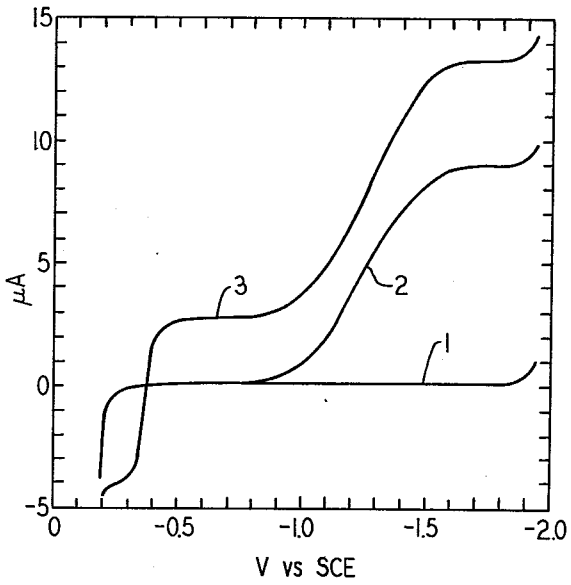
FIG. 2 shows typical polarograms for freshly made and used gold plating solutions.

FIG. 2 shows a typical polarogram of some gold plating solutions. This polarogram consists of a plot of voltage applied to the gold plating electrode as measured against a saturated calomel electrode vs. current through a test electrode containing gold plating solution. Test electrodes for polarographic measurements may be made in a variety of ways well known in the polarography field. In the measurements described here specific amounts of gold plating solution were added to a one molar aqueous solution of KOH containing 0.05 molar disodium salt of ethylene diaminetetra-acetic acid (EDTA) and 0.005 percent by weight of polyacrylamide. The latter substance is present to prevent or suppress polarographic maxima and the EDTA salt to complex cobalt ions. Here, 2.5 ml gold plating solution, remainder KOH solution described above to make 50 ml was used for the measurements.

Curve 1 shows the residual or background current due to the contents of the polarographic cells without gold plating solution. Curve 2 is a polarogram of a freshly prepared gold plating solution. It is believed that this solution does not contain any gold III species. Curve 3 shows the polarogram of a used gold plating solution. It is believed that the prewave in curve 3 is due to gold III species (principally or entirely $Au(CN)_4^-$). By use of pure samples of $KAu(CN)_4$ and suitable analysis of the reduction reaction responsible for the polarogram, estimates can be made of the concentration of gold III species in the gold plating solution. Data obtained in this way is used to estimate the efficiency of various anode materials in suppressing the formation of undesirable gold III species in gold plating processes.

Figure 3:
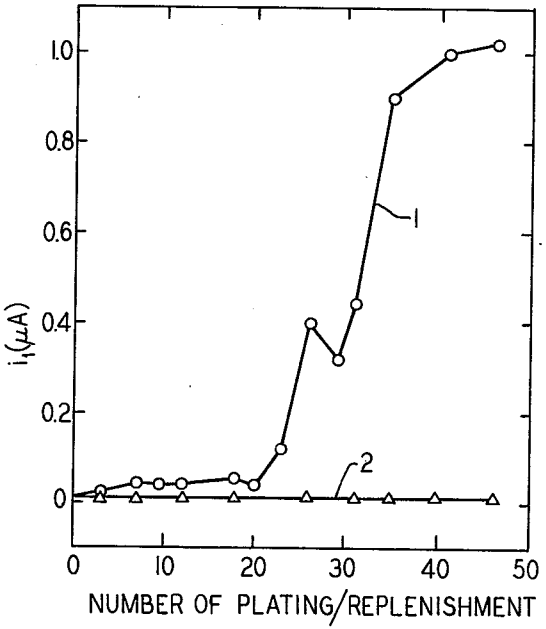
FIG. 3 shows a comparison of gold III cyanide concentration in a gold plating bath in terms of excess cathode polarographic current as a function of bath use for conventional and inventive anodes.

FIG. 3 shows a plot of amount of gold III species formed in a gold plating bath as a function of plates per replenishment. Curve 1 was obtained using a conventional gold plating procedure with a conventional platinum anode. Curve 2 was obtained under identical conditions by using a gold plating procedure with a dimensionally stable anode. As can be seen from the data set forth in FIG. 3, use of the dimensionally stable anode in gold plating procedures minimizes or eliminates the formation of gold III species which not only insures high efficiency plating, but also insures constant plating efficiency which permits a more accurate estimation of the gold plating thickness based on amount of current used.

The gold III species may be removed from the gold plating bath by a suitable special treatment using a particular reducing agent. Care must be exercised in selecting the treatment and reducing agent to insure that such treatment does not interfere with the plating properties of the gold plating solution. Generally, a hydrazine solution is used as the reducing agent because of the finding that this solution combined with proper treatment subsequent to an addition to the gold plating solution drastically reduces or eliminates the presence of gold III species. Generally, about 0.25 milliliters of an 85% hydrazine solution is added per 100 milliliters of plating solution. The solution is then heated to an elevated temperature between 50° and the boiling temperature of the solution for 2 to 6 hours. A heating temperature of 75° C for 4 hours is preferred because it eliminates or drastically reduces the concentration of gold III species without excessive temperatures which might be detrimental to the properties of the gold plating solution or excessive time which is economically wasteful. The treatment is generally repeated to insure substantial removal of gold III species. Excessive use of hydrazine should be avoided because of its adverse effect on the chemical and physical properties of the gold plating solution.

The hydrazine treatment may be tailored to the particular gold plating solution by use of the polarographic measuring technique. This is particularly advantageous for the extensively used gold plating solution which may have relatively significant amounts of gold III species. The concentration of the gold III species may be estimated using the polarographic measuring technique as described above. Standards for the quantitative estimate of gold III species concentrations may be obtained by use of solutions with known concentrations of $Au(CN)_2^-$ and $Au(CN)_4^-$. From these measurements the stoichiometric amounts of hydrazine required for the reduction of gold III to gold I may be added to the solution. Further, polarographic measurements may be made to insure substantially complete reduction of the gold III species or to estimate amounts of hydrazine needed for subsequent treatments. In this way, the gold III species can be drastically reduced in concentration or eliminated from the gold plating solution without exposing such solution to excessive amounts of hydrazine which may be detrimental to the solution.

Further treatment of the gold plating solution may be beneficial to gold plating properties. Exposure of the gold plating solution to adsorbents such as charcoal is beneficial particularly to eliminate certain impurities. For example, active charcoal such as Darco Red Label Carbon may be added to the gold plating solution and a mixture subsequently heated to approximately 60 degrees C to boiling temperature for approximately 15–100 minutes. This treatment generally removes small amounts of impurities which may be detrimental to the gold plating properties of the plating solution.

What is claimed is:

1. A process for electroplating gold on surfaces using: anode, surface to be plated as cathode, gold plating solution and an electrical source of energy comprising the step of activating the source of electrical energy so that current flows through the anode, the gold plating solution and the cathode; characterized in that the formation of gold III species is minimized by use of an anode structure which comprises a base made of titanium with metal oxide on the surface in which at least 25 percent by weight of the metal oxide is at least one oxide selected from the group consisting of ruthenium oxide, iridium oxide, rhodium oxide, and titanium oxide or mixtures thereof.

2. The process of claim 1 in which the active material is selected from the group consisting of ruthenium oxide and iridium oxide.

3. The process of claim 2 in which the active material is ruthenium oxide.

4. The process of claim 3 in which the metal oxide consists essentially of ruthenium oxide.

5. The process of claim 1 in which the gold plating solution has a pH in the range from 3–10.

6. The process of claim 5 in which the gold plating solution comprises potassium gold cyanide with citrate buffer.

7. The process of claim 5 in which the gold plating solution contains potassium gold cyanide and phosphate as the buffer.

8. The process of claim 5 in which the gold plating solution contains a hardening ion to produce hard gold plating.

9. The process of claim 1 in which hydrazine is added to the gold plating solution to reduce the concentration of gold III species.

10. The process of claim 9 in which polarographic measurements are made to estimate the amount of hydrazine needed to reduce the gold III species.

11. The process of claim 1 in which active charcoal is used to reduce impurities in the gold plating solution.

* * * * *